US006105322A

United States Patent [19]

Chang

[11] Patent Number: 6,105,322

[45] Date of Patent: Aug. 22, 2000

[54] COMBINATION PARTITION WALL

[76] Inventor: Ching-Chang Chang, No. 323, Chien-Feng Rd., Feng-Tien Li, Ping-Tung City, Ping-Tung Hsien, Taiwan

[21] Appl. No.: 09/129,948

[22] Filed: Aug. 6, 1998

[51] Int. Cl.[7] ..... E04H 1/00

[52] U.S. Cl. ..... 52/238.1; 52/239; 52/584.1; 52/591.3; 52/800.11; 52/800.12; 160/135

[58] Field of Search ..... 52/238.1, 243.1, 52/239, 584.1, 586.1, 591.3, 800.11, 800.12; 160/135

[56] References Cited

U.S. PATENT DOCUMENTS

| | | | |
|---|---|---|---|
| 3,293,813 | 12/1966 | Emmons et al. | 52/238.1 |
| 4,434,596 | 3/1984 | McAteer et al. | 52/243.1 |
| 4,914,880 | 4/1990 | Albertini | 52/243 |
| 5,125,201 | 6/1992 | Pieters et al. | 52/238.1 |
| 5,474,402 | 12/1995 | Wu | 403/405.1 |
| 5,546,718 | 8/1996 | Way | 52/238.1 |
| 5,603,192 | 2/1997 | Dickson | 52/238.1 |
| 5,724,779 | 3/1998 | Chang | 52/239 |
| 5,875,596 | 3/1999 | Muller | 52/239 |

*Primary Examiner*—Carl D. Friedman
*Assistant Examiner*—Jennifer I. Thissell
*Attorney, Agent, or Firm*—Varndell & Varndell, PLLC

[57] ABSTRACT

A combination partition wall includes a plurality of unit partition wall panels each comprised of a vertical left frame bar, a vertical right frame bar, a horizontal top frame bar and a horizontal bottom frame bar connected in parallel between the vertical left frame bar and the vertical right frame bar at top and bottom sides, and two face panels connected in parallel at front and rear sides between the vertical left frame bar and vertical right frame bar and the horizontal top frame bar and horizontal bottom frame bar, at least one horizontal top rail respectively covered on the horizontal top frame bars of the unit partition wall panels at the top, at least one horizontal bottom rail respectively covered on the horizontal bottom frame bars of the unit partition wall panels at the bottom, a plurality of first coupling plates respectively mounted on the vertical left frame bars of the unit partition wall panels and the horizontal bottom rail for coupling the vertical left frame bar of one unit partition wall panel to the vertical right frame bar of another unit partition wall panel and the at least one horizontal bottom rail to the horizontal bottom frame bars of the unit partition wall panels.

2 Claims, 6 Drawing Sheets

COMBINATION PARTITION WALL

BACKGROUND OF THE INVENTION

The present invention relates to a combination partition wall panel which can be quickly set up at the job site subject to as desired.

According to conventional methods, it is inconvenient to set up a partition wall in a room or building. Further, when a partition wall is set up in a room or building, it cannot be quickly dismounted. In case the design of the partition wall has to be changed, the partition wall may have to be destroyed.

SUMMARY OF THE INVENTION

The present invention has been accomplished to provide a combination partition wall which eliminates the aforesaid problems. It is one object of the present invention to provide a combination partition wall which can be quickly set up at the job site. It is another object of the present invention to provide a combination partition wall which is detachable when set up. It is still another object of the present invention to provide a combination partition wall which is constructed of modularized parts that are inexpensive to manufacture. According to the preferred embodiment of the present invention, the combination partition wall comprises a plurality of unit partition wall panels each comprised of a vertical left frame bar, a vertical right frame bar, a horizontal top frame bar and a horizontal bottom frame bar connected in parallel between the vertical left frame bar and the vertical right frame bar at top and bottom sides, and two face panels connected in parallel at front and rear sides between the vertical left frame bar and vertical right frame bar and the horizontal top frame bar and horizontal bottom frame bar, at least one horizontal top rail respectively covered on the horizontal top frame bars of the unit partition wall panels at the top, at least one horizontal bottom rail respectively covered on the horizontal bottom frame bars of the unit partition wall panels at the bottom, a plurality of first coupling plates respectively mounted on the vertical left frame bars of the unit partition wall panels and the horizontal bottom rail for coupling the vertical left frame bar of one unit partition wall panel to the vertical right frame bar of another unit partition wall panel and the at least one horizontal bottom rail to the horizontal bottom frame bars of the unit partition wall panels.

DETAILED DESCRIPTION OF THE PREFERRED EMBODIMENT

Figure 1:
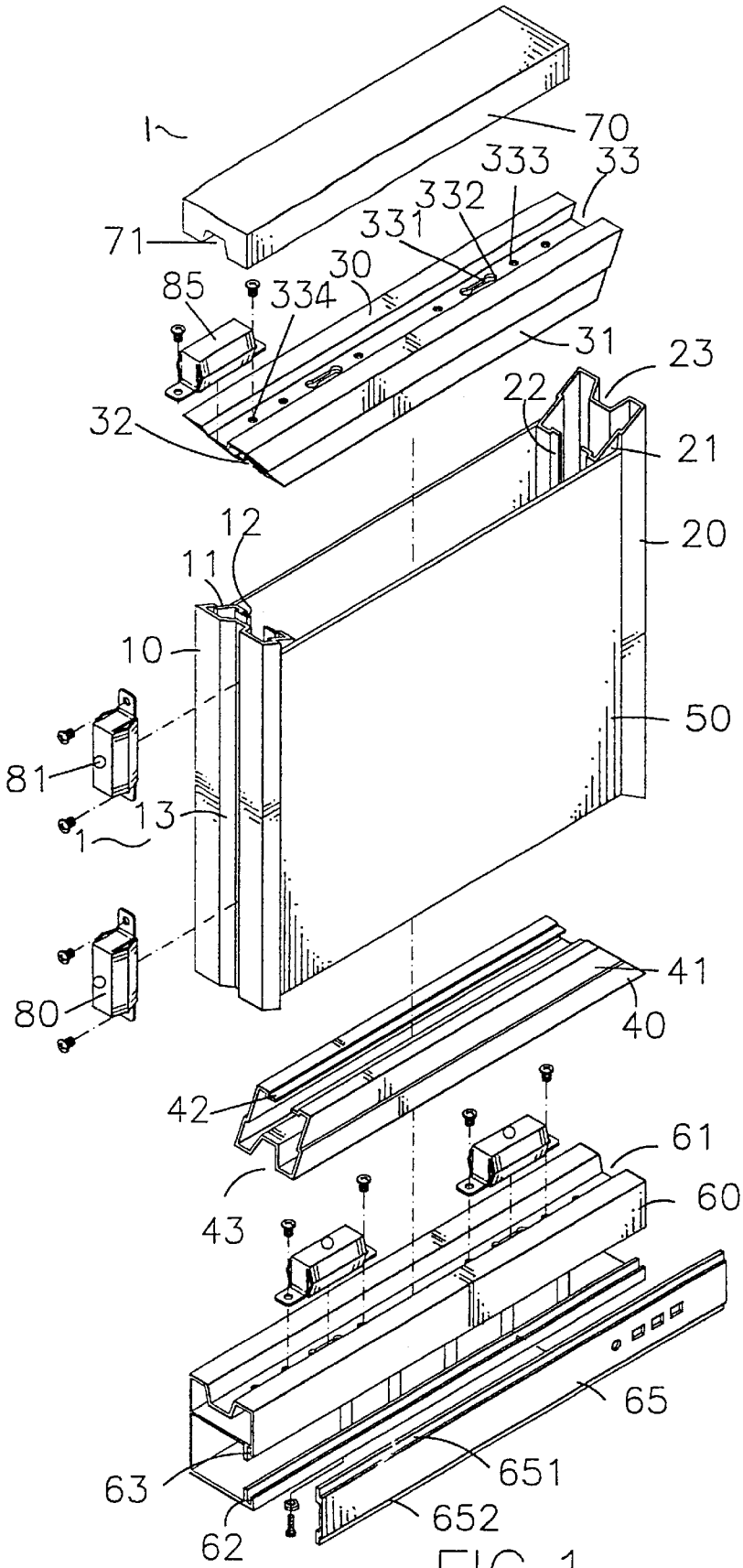
FIG. 1 is an exploded view of a unit partition wall panel according to the present invention.
Figure 2:
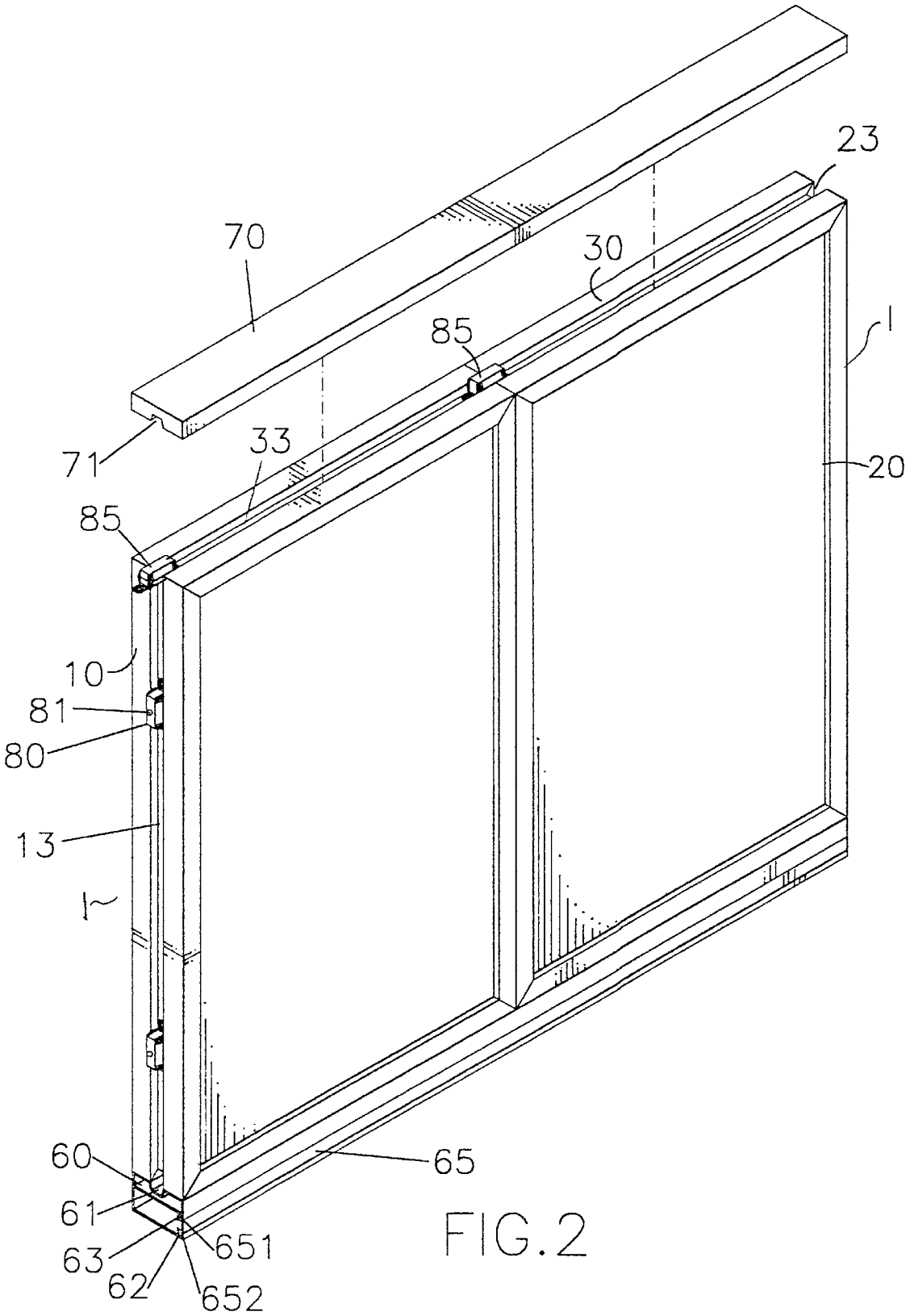
FIG. 2 shows two unit partition wall panels fastened together according to the present invention.
Figure 4:
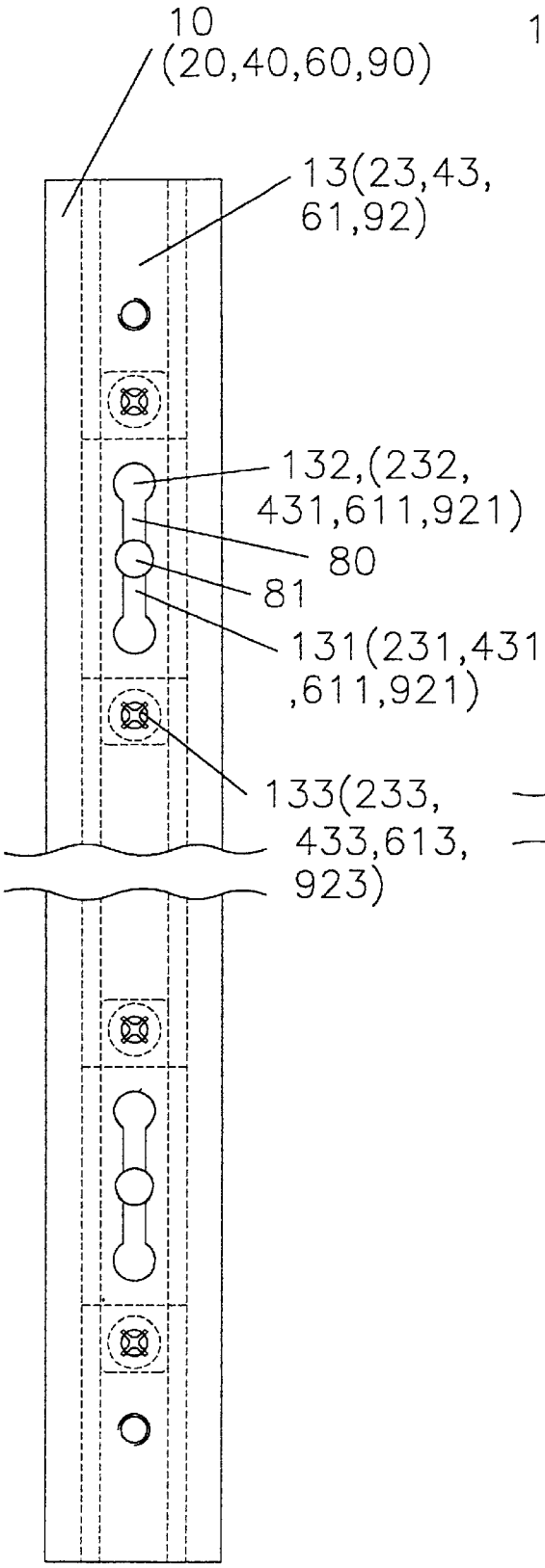
FIG. 4 is similar to FIG. 3 but showing the respective round head pins engaged into the respective elongated slots.
Figure 3:
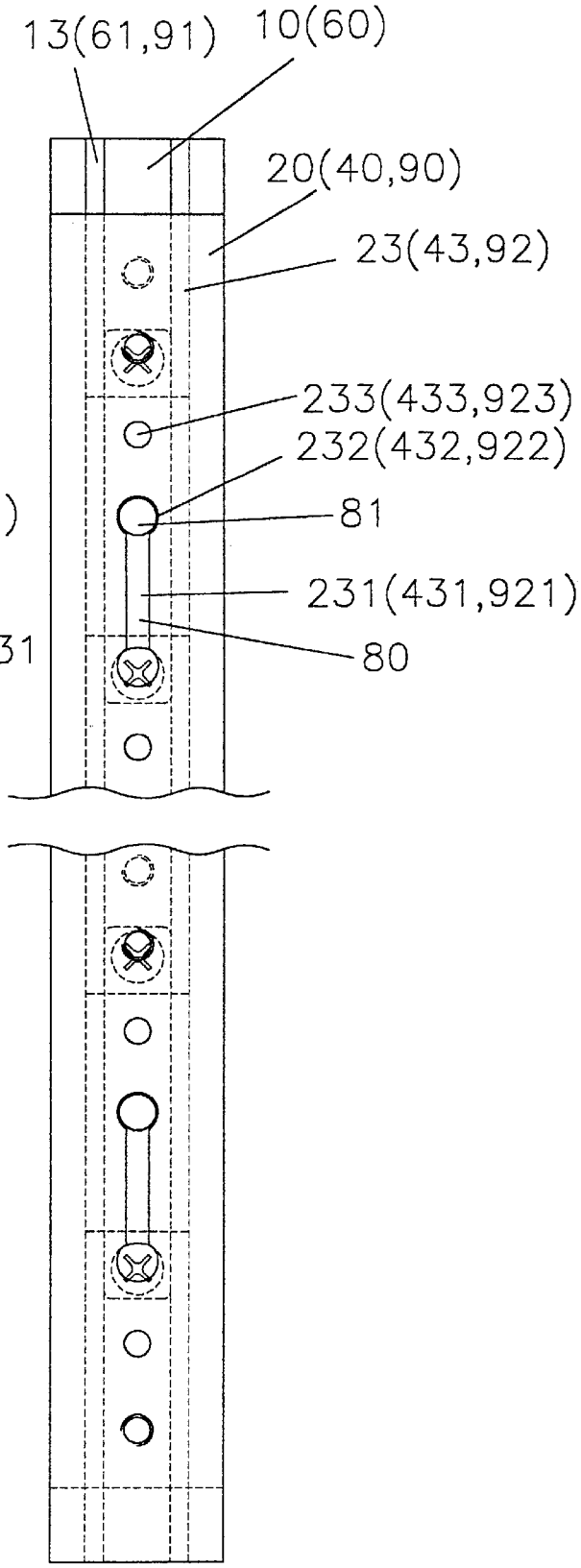
FIG. 3 illustrates the coupling arrangement of the first coupling plates according to the present invention, showing the round head pins inserted through the respective round holes.
Figure 5:
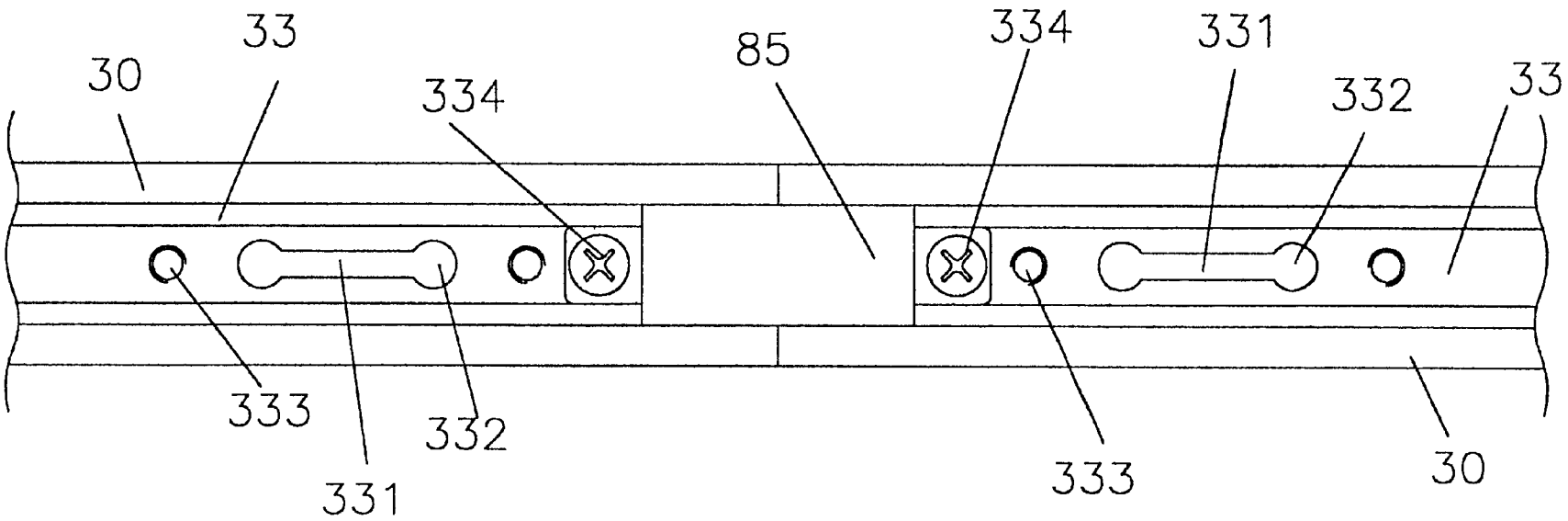
FIG. 5 shows a second coupling plate connected between the horizontal top frame bars of two unit partition wall panels according to the present invention.
Figure 7:
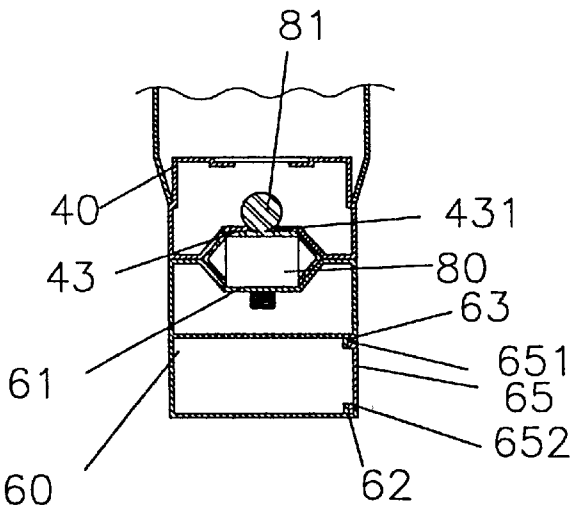
FIG. 7 is a sectional view of a part of the present invention, showing the positioning of a first coupling plate between the horizontal bottom frame bar of one unit partition wall panel and the horizontal bottom rail.
Figure 6:
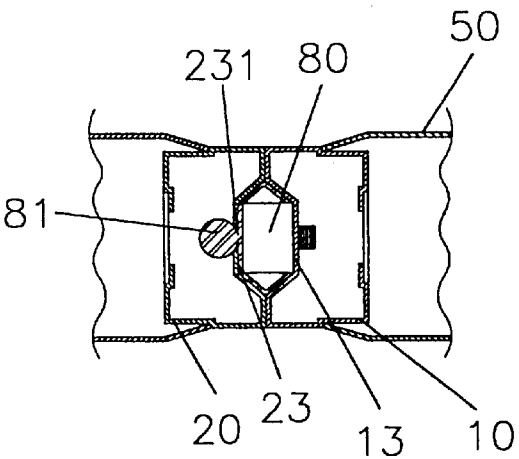
FIG. 6 is a sectional view of a part of the present invention, showing the positioning of a first coupling plate between two unit partition wall panels.

Referring to FIGS. 1 and 2, a combination partition wall in accordance with the present invention comprises a plurality of unit partition wall panels 1 covered between a horizontal bottom rail 60, which is covered with a bottom rail cover plate 65, and a horizontal top rail 70. Each unit partition wall panel is comprised of a vertical left frame bar 10, a vertical right frame bar 20, a horizontal top frame bar 30, a horizontal bottom frame bar 40, front and rear face panels 50.

The vertical left and right frame bars 20,30 each have two longitudinal inner sliding grooves 11,21 bilaterally arranged in parallel at an inner side for receiving the face panels 50, a longitudinal inner middle groove 12,22 on the middle at an inner side between the longitudinal sliding grooves 11,21, a longitudinal outer middle groove 13,23 on the middle at an outer side, two elongated slots 131,231 longitudinally aligned within the longitudinal outer middle groove 13,23 near two opposite ends, two pairs of screw holes 133,233 provided at the longitudinal outer middle groove 13,23 and respectively spaced from each elongated slot 131,231 at two opposite ends, and two pairs of round holes 132,232 respectively connected to two opposite ends of each elongated slot 131,231. Further, two first coupling plates 80 are mounted in the longitudinal outer middle groove 13 of the vertical left frame bar 10 and fastened to the screw holes 133, each having a round head pin 81 on the middle.

The horizontal top and bottom frame bars 30,40 each have two longitudinal inner sliding grooves 31,41 bilaterally arranged in parallel at the bottom or top side for receiving the face panels 50, a longitudinal inner middle groove 32,42 on the middle at the bottom or top side between the longitudinal sliding grooves 31,41, a longitudinal outer middle groove 33,43 on the middle at the top or bottom side, two elongated slots 331,431 longitudinally aligned within the longitudinal outer middle groove 33,43 near two opposite ends, two pairs of screw holes 333,433 provided at the longitudinal outer middle groove 33,43 and respectively spaced from each elongated slot 331,431 at two opposite ends, and two pairs of round holes 332,432 respectively connected to two opposite ends of each elongated slot 331,431. The horizontal top frame bar 30 further comprises two screw holes 334 near two opposite ends for the mounting of a second coupling plate 85. When two unit wall panels are abutted against each other, a second coupling plate 85 is fastened to the horizontal top frame bars 30 to fixedly secure the two unit wall panels together.

The horizontal bottom rail 60 comprises a longitudinal top coupling groove 61, a plurality of elongated slots 611 provided at the top coupling groove 61 corresponding to the elongated slots 431 on the horizontal bottom frame bar 40, two pairs of screw holes 613 respectively spaced from the elongated slots 611 at two opposite ends, two pairs of round holes 612 respectively connected to the elongated slots 611 at two opposite ends, and two first coupling plates 80 mounted in the longitudinal top coupling groove 611 and respectively fastened to the screw holes 613, and two vertically spaced longitudinal front coupling grooves 62,63 for the mounting of the bottom rail cover plate 65. The bottom rail cover plate 65 is covered on the horizontal bottom rail 60 at the front side, having two longitudinal coupling flanges 651,652 respectively engaged into the longitudinal front coupling grooves 62,63.

The horizontal top rail 70 is covered on the horizontal top frame bar 30 of each unit partition wall panel, having a longitudinal bottom groove 71, which receives the second coupling plate 85 at each horizontal top frame bar 30.

Referring to Figures from 3 through 7, when setting up a combination partition wall, the round head pins 81 of the first coupling plates 80 at the vertical left frame bar 10 of one unit partition wall panel are respectively inserted through the round holes 232 at the vertical right frame bar 20 of another unit partition wall panel 1 and moved into the respective elongated slots 231, the round head pins 81 of the first coupling plates 80 at the horizontal bottom rail 60 are respectively inserted through the round holes 432 at the horizontal bottom rail 40 of each unit partition wall panel and then moved into the respective elongated slots 431, the front and rear face panels 50 are respectively inserted into the longitudinal inner sliding grooves 11,21,31,41 of the vertical left and right frame bars 10,20 and the horizontal top and bottom frame bars 30,40 of the respective unit partition wall panels 1. When unit partition wall panels are respectively assembled and secured to the horizontal bottom rail 60, the horizontal top rail 70 is covered on the horizontal top frame bar 30 of each unit partition wall panel 1. When dismounting the combination partition wall, the horizontal top rail 70 and the second coupling plates 85 are respectively removed from the combination partition wall, then the round head pins 81 of the respective first coupling plates 80 are moved from the respective elongated slots 231,431 to the respective round holes 232,432, and thus the unit partition wall panels 1 can then be disconnected from one another and separated from the horizontal bottom rail 60.

Figure 9:
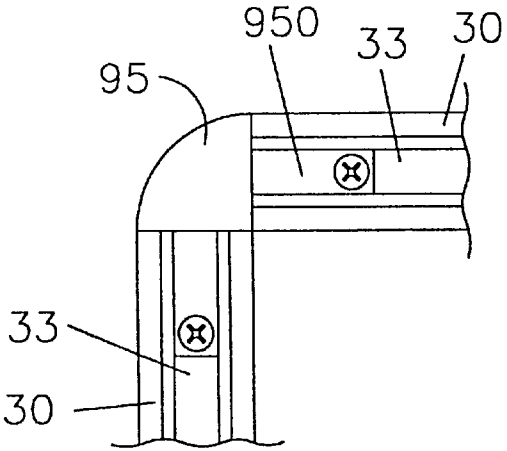
FIG. 9 is a sectional view of a part of the present invention, showing the top end cap fastened to the vertical corner frame bar and the horizontal top frame bar of one unit partition wall panel.
Figure 8:
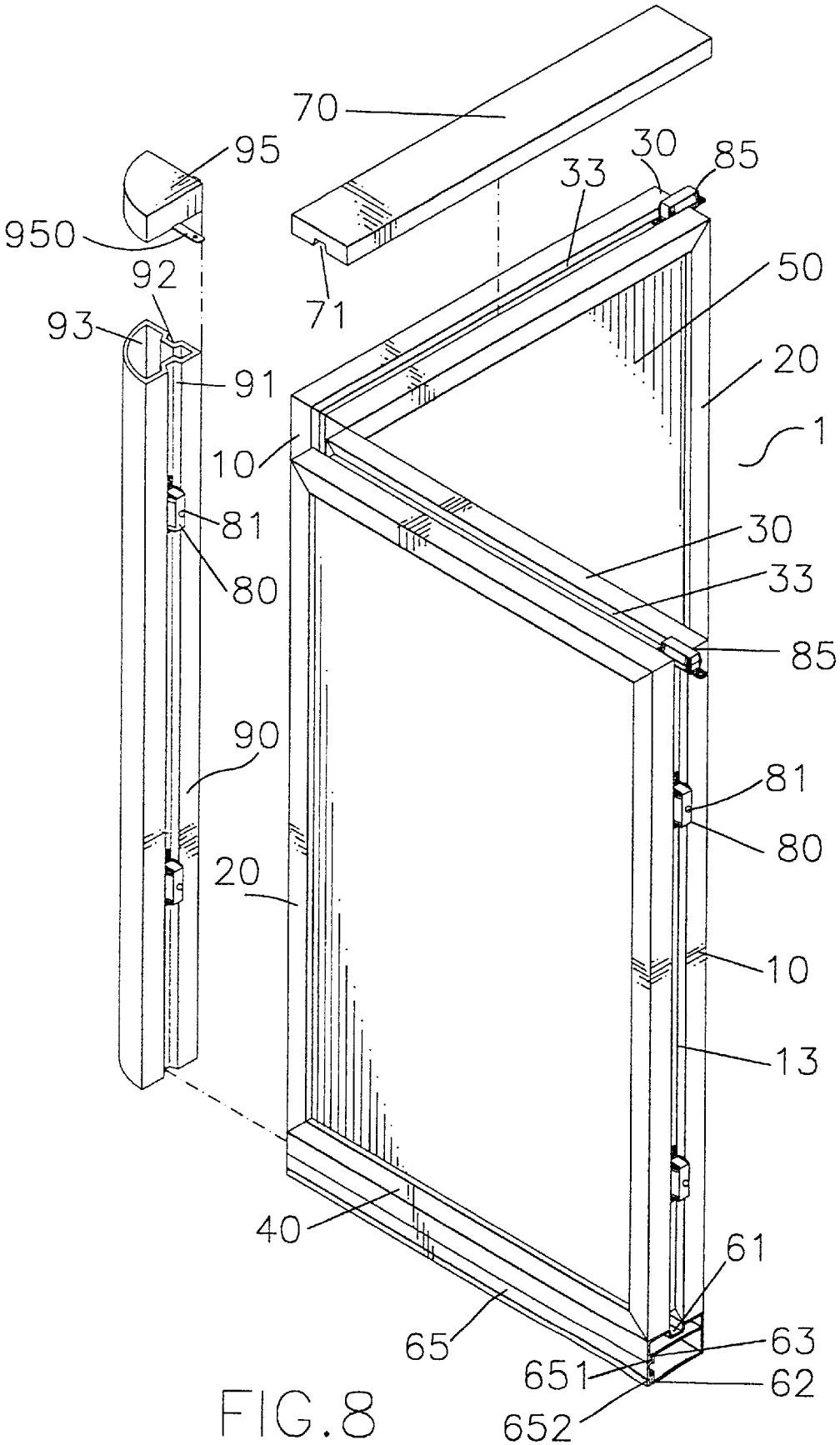
FIG. 8 is an exploded view of a part of the present invention, showing the positioning of a vertical corner frame bar at two unit partition wall panels.

Referring to FIGS. 8 and 9, a vertical corner frame bar 90 is installed to connect two unit partition wall panels 1 at right angles. The vertical corner frame bar 90 has a 90° sector-like cross section, a longitudinal center through hole 93, two longitudinal mounting grooves 91,92 at two adjacent sides, two pairs of first coupling plates 80 respectively fixedly fastened to the longitudinal mounting grooves 91,92 near two opposite ends. During the assembly process, the round head pins 81 of the first coupling plates 80 at the vertical corner frame bar 90 are respectively inserted through the corresponding to the elongated slots 131 at the vertical left frame bar 10 of a first unit partition wall panel and the elongated slots 231 at the vertical right frame bar 20 of a second unit partition wall panel, and then moved into the respective round holes 132,232. Further a top end cap 95 is plugged into the longitudinal center through hole 93 and stopped at the top side of the vertical corner frame bar 90. The top end cap 95 has a projecting mounting strip 950 inserted into the longitudinal outer middle groove 33 of the horizontal top frame bar 30 of one unit partition wall panel and fixedly secured thereto by a fastening element for example a screw.

What is claimed is:

1. A combination partition wall comprising:

a plurality of unit partition wall panels each comprised of a vertical left frame bar, a vertical right frame bar, a horizontal top frame bar and a horizontal bottom frame bar connected in parallel between said vertical left frame bar and said vertical right frame bar at top and bottom sides, and two face panels connected in parallel at front and rear sides between said vertical left frame bar and vertical right frame bar and said horizontal top frame bar and horizontal bottom frame bar, said vertical left and right frame bars each having two longitudinal inner sliding grooves bilaterally arranged in parallel at an inner side for receiving said face panels, a longitudinal inner middle groove on the middle at an inner side between the respective longitudinal sliding grooves, a longitudinal outer middle groove on the middle at an outer side, two elongated slots longitudinally aligned within the respective longitudinal outer middle groove near two opposite ends, two pairs of screw holes provided at the respective longitudinal outer middle groove and respectively spaced from each of the respective elongated slots at two opposite ends, and two pairs of round holes respectively connected to two opposite ends of each of the respective elongated slots, said horizontal top and bottom frame bars each having two longitudinal inner sliding grooves bilaterally arranged in parallel at an inner side for receiving said face panels, a longitudinal inner middle groove on the middle between the respective longitudinal sliding grooves, a longitudinal outer middle groove on the middle at an outer side, two elongated slots longitudinally aligned within the respective longitudinal outer middle groove near two opposite ends, two pairs of screw holes provided at the respective longitudinal outer middle groove and respectively spaced from each of the respective elongated slots at two opposite ends, and two pairs of round holes respectively connected to two opposite ends of each of the respective elongated slot;

a plurality of first coupling plates respectively fastened to the screw holes at the vertical left frame bars of said unit partition wall panels and the screw holes at said at least one horizontal bottom rail for coupling the vertical left frame bar of one unit partition wall panel to the vertical right frame bar of another unit partition wall panel and said at least one horizontal bottom rail to the horizontal bottom frame bars of said unit partition wall panels, said first coupling plates each have a round head pin for inserting through the round holes at the vertical right frame bars and horizontal bottom frame bar of said unit partition wall panels and then engaging into the respective elongated slots;

a plurality of second coupling plates respectively inserted into the longitudinal outer middle groove at the horizontal top frame bars of said unit partition wall panels and respectively fixedly connected between the horizontal top frame bars of each adjacent unit partition wall panels by screws;

at least one horizontal bottom rail which respectively supports said unit partition wall panels and is respectively covered on the horizontal bottom frame bars of said unit partition wall panels, said at least one horizontal bottom rail each comprising a longitudinal top coupling groove, a plurality of elongated slots provided at the top coupling groove corresponding to the elongated slots on the horizontal bottom frame bar of each unit partition wall panel, two pairs of screw holes respectively spaced from the elongated slots of said horizontal bottom rail at two opposite ends, two pairs of round holes respectively connected to the elongated slots of said horizontal bottom rail at two opposite ends, and two vertically spaced longitudinal front coupling grooves;

at least one bottom rail cover plate respectively covered on said at least one horizontal bottom rail at a front side, said at least one bottom rail cover plate each having two longitudinal coupling flanges respectively engaged into the longitudinal front coupling grooves of each of said at least one horizontal bottom rail; and at least one horizontal top rail covered on the horizontal top frame bars of said unit partition wall panels, said at least one horizontal top rail each having a longitudinal bottom groove at an inner side, which receives said second coupling plates.

2. The combination partition wall of claim 1, wherein, at least one vertical corner frame bar for connecting two unit partition wall panels at right angles, said at least one vertical corner frame bar each having a 90° sector-like cross section, a longitudinal center through hole, two longitudinal mounting grooves at two adjacent sides, two pairs of first coupling plates respectively fixedly fastened to said longitudinal mounting grooves near two opposite ends, said first coupling plates each having a round head pin respectively inserted through the corresponding to the elongated slots at the vertical left frame bar of a first unit partition wall panel and the elongated slots at the vertical right frame bar of a second unit partition wall panel and then engaged into the respective round holes at the respective vertical left frame bar and the respective vertical right frame bar, and a top end cap plugged into said longitudinal center through hole, said top end cap having a projecting mounting strip inserted into the longitudinal outer middle groove of the horizontal top frame bar of one unit partition wall panel and fixedly secured thereto by a fastening element.

* * * * *